US007632133B2

(12) United States Patent
Wu

(10) Patent No.: US 7,632,133 B2
(45) Date of Patent: Dec. 15, 2009

(54) CROSS CONNECT TERMINAL BLOCK

(75) Inventor: Chen-Hsin Wu, Taoyuan (TW)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/281,117

(22) PCT Filed: Feb. 20, 2007

(86) PCT No.: PCT/US2007/004405

§ 371 (c)(1),
(2), (4) Date: Aug. 28, 2008

(87) PCT Pub. No.: WO2007/102983

PCT Pub. Date: Sep. 13, 2007

(65) Prior Publication Data

US 2009/0130919 A1 May 21, 2009

(30) Foreign Application Priority Data

Mar. 6, 2006 (TW) ..... 95107484 A

(51) Int. Cl.
*H01R 4/24* (2006.01)

(52) U.S. Cl. ..... 439/409; 439/417

(58) Field of Classification Search ..... 439/409–417
See application file for complete search history.

(56) References Cited

U.S. PATENT DOCUMENTS 4,009,922 A 3/1977 Aysta
4,127,312 A 11/1978 Fleischhacker et al.
4,210,378 A 7/1980 Baribeau
4,279,460 A 7/1981 Forberg
4,326,767 A 4/1982 Silbernagel et al.
4,341,430 A 7/1982 Crawford
4,431,247 A 2/1984 Abdullah et al.
4,533,196 A 8/1985 Forberg et al.
4,789,354 A 12/1988 Smith et al.
4,815,988 A 3/1989 Scherer
5,147,218 A 9/1992 Matthews et al.
5,173,064 A * 12/1992 Audeval ..... 439/395
5,175,662 A 12/1992 DeBalko et al.
5,178,558 A 1/1993 Knox et al.

(Continued)

FOREIGN PATENT DOCUMENTS

GB 2 129 630 A 5/1984

(Continued)

*Primary Examiner*—Briggitte R Hammond
(74) *Attorney, Agent, or Firm*—Janet A. Kling

(57) ABSTRACT

A cross connect terminal block, comprising: a base; at least one set of terminals disposed in the base, the terminal having a first end and a second end, the first end being used for connecting with a first set of wires and the second end being used for connecting with a second set of wires; at least a first cover removably disposed on the base and having a support means for supporting the first set of wires, the support means of the first cover being located at a position corresponding to the first end of the terminal; and at least a second cover removably disposed on the base and having a support means for supporting the second set of wires, the support means of the second cover being located at a position corresponding to the second end of the terminal.

17 Claims, 12 Drawing Sheets

U.S. PATENT DOCUMENTS

| | | | | |
|---|---|---|---|---|
| 5,281,163 | A | | 1/1994 | Knox et al. |
| 5,314,350 | A | * | 5/1994 | Matthews et al. ..... 439/404 |
| 5,451,170 | A | | 9/1995 | Suffi |
| 5,496,192 | A | | 3/1996 | Hower et al. |
| 5,504,654 | A | | 4/1996 | Knox et al. |
| 5,860,829 | A | | 1/1999 | Hower et al. |
| 6,010,372 | A | | 1/2000 | Ward |
| 7,059,864 | B2 | | 6/2006 | Matthies et al. |
| 7,066,764 | B2 | | 6/2006 | Bolouri-Saransar |
| 2005/0250389 | A1 | | 11/2005 | Johansen et al. |
| 2006/0057884 | A1 | | 3/2006 | Fasce et al. |

FOREIGN PATENT DOCUMENTS

| | | |
|---|---|---|
| JP | 09-092356 | 4/1997 |
| JP | 2000-175226 | 6/2000 |

* cited by examiner

CROSS CONNECT TERMINAL BLOCK

CROSS REFERENCE TO RELATED APPLICATIONS

This application is a national stage filing under 35 U.S.C. 371 of PCT/US2007/004405, filed Feb. 20, 2007, which claims priority to Taiwan Patent Application No. 095107484, filed Mar. 6, 2006, the disclosures of which are incorporated by reference in their entirety herein.

BACKGROUND OF THE INVENTION

1. Field of the Invention

The present invention relates to the field of electrical connectors. More particularly, the present invention relates to a cross connect terminal block applied in a telecommunication system for providing the connection from TIPs and RINGs wire sets (for transmitting wiring signals) of the central office to wire sets in distributed wires. The cross connect terminal block of the present invention can further include one or two sets of wiring plugs at the same time, and can optionally include an electrical protection means, so as to provide the connected wire sets with the protection against over voltage or over current, such as lightning strikes.

2. Description of the Prior Art

Cross connect terminal blocks are conventional, and have been applied in telecommunication systems as terminal blocks of a wire extending from the central office, such that the wire is matched and connected with a wire of user terminals. When a cross connect terminal block is used, the large-scale cable extending from the central office is usually one terminal thereof, and several small-scale cables tapped out from the cross connect terminal block are connected to other cross connect terminal blocks arranged in parallel, such that the wire sets of the cables in the central office may be connected to the wire sets of user terminals correctly. The cross connect terminal blocks allow the switch of telephone lines and tests on the lines, and realize the transmission of signals. To some arrangement modes, the cross connect terminal blocks also allow additional telephone lines to be connected to original lines.

Some patents on cross connect terminal blocks have been disclosed already. For example, U.S. Pat. No. 4,210,378 uses screws as fixing posts to realize connection of different pairs of wires, and the connection with the module is permanent in this invention, so the change for the wires is difficult. Prior arts that eliminate this defect and realize rapid and convenient connection include U.S. Pat. No. 4,431,247 and U.S. Pat. No. 4,815,988, and other different types of cross connect terminal blocks are available in U.S. Pat. No. 4,279,460 and U.S. Pat. No. 4,789,354. In theses prior arts, wire sets from a signal wire can easily be added to wire sets in the neighboring cross connect block through wires between contact elements of two blocks.

In addition to the content about the cross connect systems and cross connect terminal blocks disclosed in the prior arts, patents on connectors having insulative layers removed, such as U.S. Pat. Nos. 4,341,430 and 4,533,196, and GB Patent No. 2,129,630, have disclosed various types of telecommunication or electrical connectors. In these patents, wires are introduced into a U-shaped slot of a metal contact element, and the U-shaped element is used to remove the insulative layer of the wires, such that the conductor in the wires is pressed with an elastic force, and thus is electrically connected with the contact element. U.S. Pat. No. 4,127,312 and U.S. Pat. No. 5,147,218 have disclosed the methods that use the connectors with contact elements to remove the insulative layers for connecting the bare wires so as to realize connection of different sets of wires. U.S. Pat. No. 4,127,312 has described two end portions of each contact that are arranged at an angle of 90 degrees and are used differently. First, the portion of a contact with the insulative layer removed is used to enable the contact to be connected to the bare wires, and the opposite side of the contact has a tuning fork contact for connecting a branch portion of the contact in another connector, such that two contact elements are electrically connected. This patent has also described the method of forming this type of contacts.

Moreover, in addition to the common connection between a wire set and another wire set, U.S. Pat. No. 5,281,163 has also disclosed that wires are tapped out from the other side of a connected cross connect terminal block for other purposes, such as half tapping or test circuits. Thus, the half tapping or bridging of the circuit can be realized without interfering the continuity of the original circuit. U.S. Pat. No. 5,281,163 uses a terminal block for connecting a first set of wires and a plug for connecting a second set of wires, and inserts the plug into the terminal block to fix them, such that the normal cross connection mode is realized. Furthermore, the plug can be stacked for half tapping or testing the connection of the wire sets from the central office.

However, U.S. Pat. No. 5,281,163 is still a complicated method of connection, which has to use a fixed terminal block to connect the first set of wires, then use a plug to connect the second set of wires, and then insert the plug into the terminal block to realize the cross connection of the wire sets. Thus, more elements are required, and the operating procedure is complicated. To reduce the cost and to make the operators' work easier while maintaining the same advantages, the present invention is developed, which provides the normal cross connection function of the first set of wires and the second set of wires, and provides the half tapping or bridging of the circuit without interfering or interrupting the original loops.

SUMMARY OF THE INVENTION

One object of the present invention is to provide a cross connect terminal block, which simplifies the structure of conventional terminal blocks, such that the user can easily connect or switch lines using the structure of the terminal block itself without any additional plugs.

Another object of the present invention is to provide a cross connect terminal block that comprises less components and is easy to assemble, but realizes the same performance. The cross connect terminal block combines two contacts that are conventionally in a module and a plug respectively into one piece, and integrates the function of the plug into the terminal block of the present invention, such that the module that is capable of connecting one set of wires originally connects two sets of wires, and still maintains the function to switch the wires easily. Moreover, the cost can also be reduced.

Furthermore, still another object of the present invention is to provide a terminal block, which can further comprise independent plug elements to connect other wire sets. The plug elements can also be elements with electrical protection means, such as over voltage or over current protection means, so as to form loops with the electrical protection function. The present invention discloses in detail the detailed structure of combining the electrical protection loops and removable jumper plugs, and discloses the mode that allows further inserting connection of the jumper plugs for the aforementioned object.

Accordingly, the present invention provides a terminal block for the connection between wire sets, which comprises a base, at least one set of terminals disposed in the base, the terminal having a first end and a second end, the first end being used for connecting with a first set of wires and the second end being used for connecting with a second set of wires; at least a first cover removably disposed on the base and having a support means for supporting the first set of wires, the support means being located at a position corresponding to the first end of the terminal; and at least a second cover removably disposed on the base and having a support means for supporting the second set of wires, the support means being located at a position corresponding to the second end of the terminal. The first cover and the second cover are designed to be capable of being opened and closed easily, for example, one edge of each of the covers is hinged to the base, and the other edge is a mechanism buckled to the base. When a user needs to switch to the connection with a different wire set, the switching of the wire set can be performed by loosening the buckling mechanism, drawing out the original wire, putting in and positioning the new wire, and pressing the buckling mechanism to the position where it is buckled to the base.

If other wire sets are required to be connected without interfering the connected first wire set and second wire set, only a modularized plug having a shape that matches the shape of the terminal block is needed. At this time, the cover elements of the original terminal blocks should have apertures, so as to provide a channel along which the splicing contacts in the plug access to and electrically connect with the terminals in the base of the terminal block. A location means is formed around each of the apertures of the cover, such that each pair of apertures is polarized and can orient the plug when the plug is inserted into the terminal block. The plug comprises an insulative body having two opposite ends, and a cap configured to be capable of being opened or closed on one end of the insulative body conveniently. At least a contact for splicing is held by the plug body, and the splicing contact is formed from a thin metal plate. Each splicing contact has two opposite end portions, one of the end portions is used for electrically connecting the terminal in the base, and the other end portion is used for partially removing the insulative layer of the wire to be connected to the plug, such that the conductor in the wire is pressed by an elastic force and is electrically connected with the contact portion. The contact portion for removing the insulative layer of the wire is also used in the connection of contacts of other jumper plugs that are inserted in the plug.

A cap of the plug is similar to the cover of the terminal block. Apertures similar to those on the covers as described above can be formed on the cap, so as to provide a channel along which contacts in another plug for jumper connection (the second plug) access to and contact the contacts of the plug (the first plug). A location means is also provided in the end of the plug body which is used for matching with the cover, so as to match with the location means around the aperture of each cover, such that the contacts in the plug may easily go through the apertures of the covers and come into electrical connection with the terminals in the base. Through this design, the plugs are stacked on one another, and realize a continuous connection mode.

In one embodiment, an over voltage or over current protection loop can be disposed in the plug. As the loop formed in the plug has over voltage or over current protection function, the damage caused by a sudden increase of the voltage or current, such as the sudden increase of the voltage caused by a lightning strike, may be reduced.

BRIEF DESCRIPTION OF THE DRAWINGS

FIG. 3 also shows the shape of the splicing contacts, each of the splicing contacts has two opposite end portions, wherein one end portion has a tuning fork shape and is connected to the terminal, the other end portion has a U-shaped slot for removing the insulative layer of the wires, and the U-shaped blade is connected to the splicing contacts in other plugs. The tuning fork contacts and the contacts for removing the insulative layer are at 90 degrees around a long axis.

DETAILED DESCRIPTION

Figure 1A:
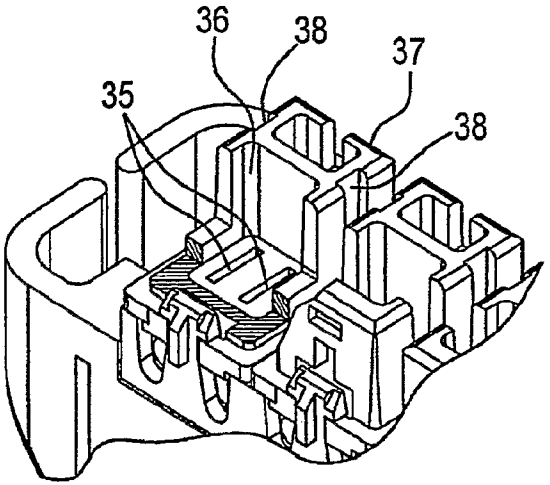
FIG. 1A is a partial sectional view of FIG. 1.

Preferred embodiments of the present invention will be illustrated below in detail with reference to the accompanying drawings, and reference numerals in the drawings are used to represent corresponding elements.

Figure 1:
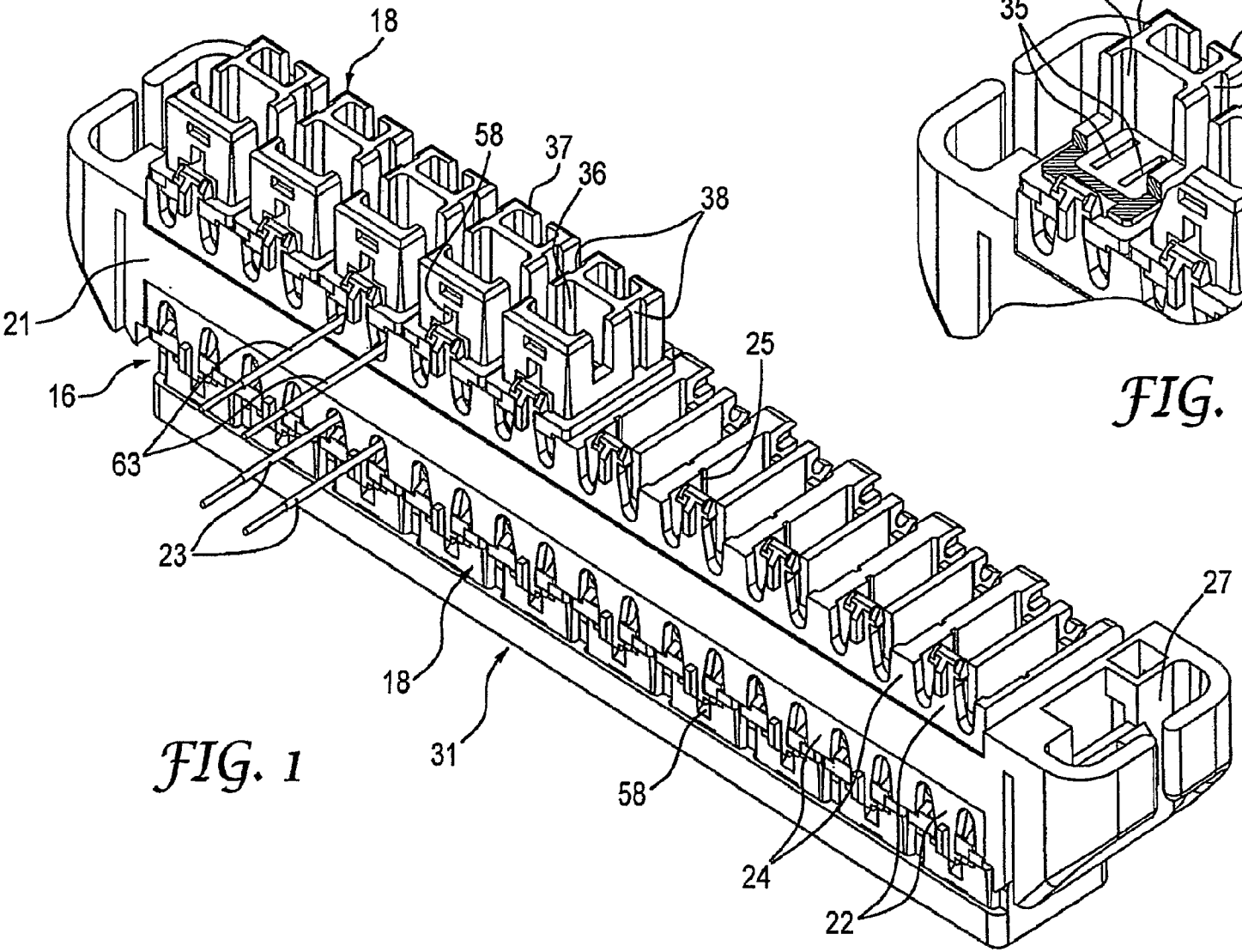
FIG. 1 is a perspective view of the present invention.
Figure 2B:
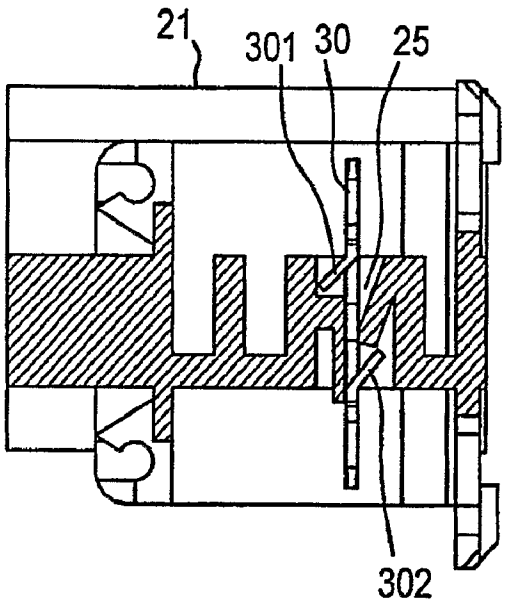
FIG. 2B is a cross section of FIG. 2A showing the state that the terminal of the terminal block of the present invention is held in the base.
Figure 2A:
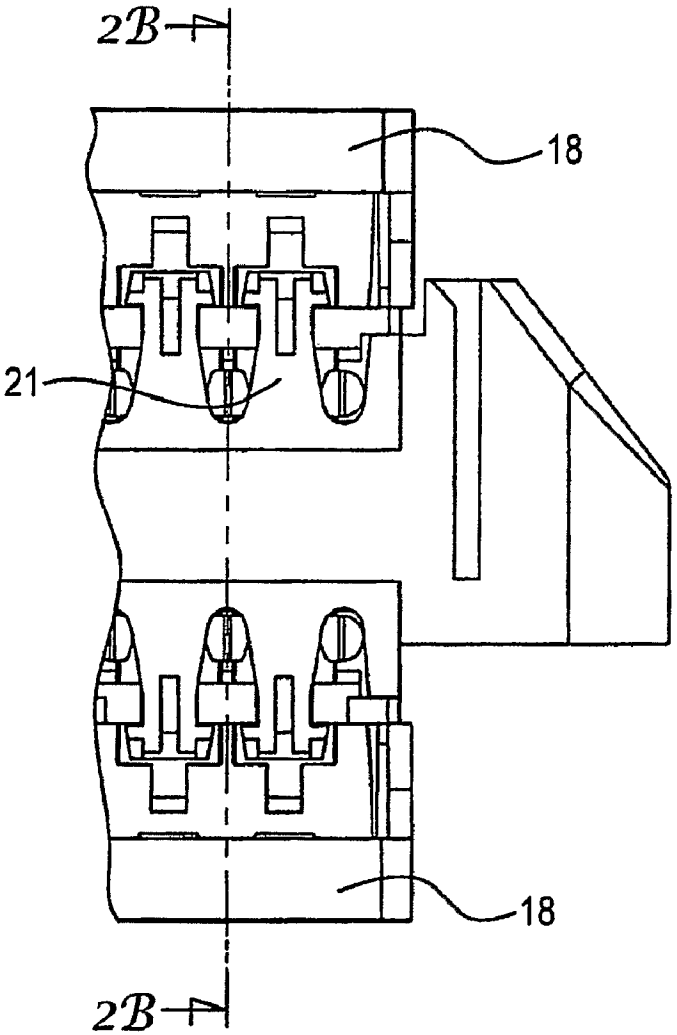
FIG. 2A is a part of the front view of a terminal block of the present invention.

As shown in FIG. 1, generally, a terminal block 16 of the present invention is rectangular, which includes a base 21 and a plurality of covers 18 arranged on upper and lower sides of the base 21. FIG. 2B shows a cross section of the terminal block 16 taken along line 2B-2B in FIG. 2A, and shows that the base 21 has a plurality of sets of terminals 30, each set of terminals 30 is used to electrically connect a first set of wires 23 and a second set of wires 63.

The base 21 is preferably formed with thermoplastic electrically insulative plastic PBT filled with glass fibers. Generally, several compartments are formed on the upper and lower surfaces of the base 21, and a plurality of sets of slots 25 for holding the terminals 30 are formed in the base 21 (see FIGS. 1 and 2B). The material of the base provides excellent electrical insulation to the terminals 30 in the slots 25, and provides sufficient strength required for the engagement of the wires and the terminals 30. The compartments are structures designed for preventing the base from warping and deforming easily in the thermoplastic molding process. The covers 18 are also formed with similar insulative material. The upper and lower sides of the base 21 both have posts 22 and 24, and the groove between the posts 22 and 24 helps to support the first set of wires 23 and the second set of wires 63 held in the covers 18. Thus, the size of the groove between the posts 22 and 24 is slightly greater than the outer diameter of the wires.

Figure 3:
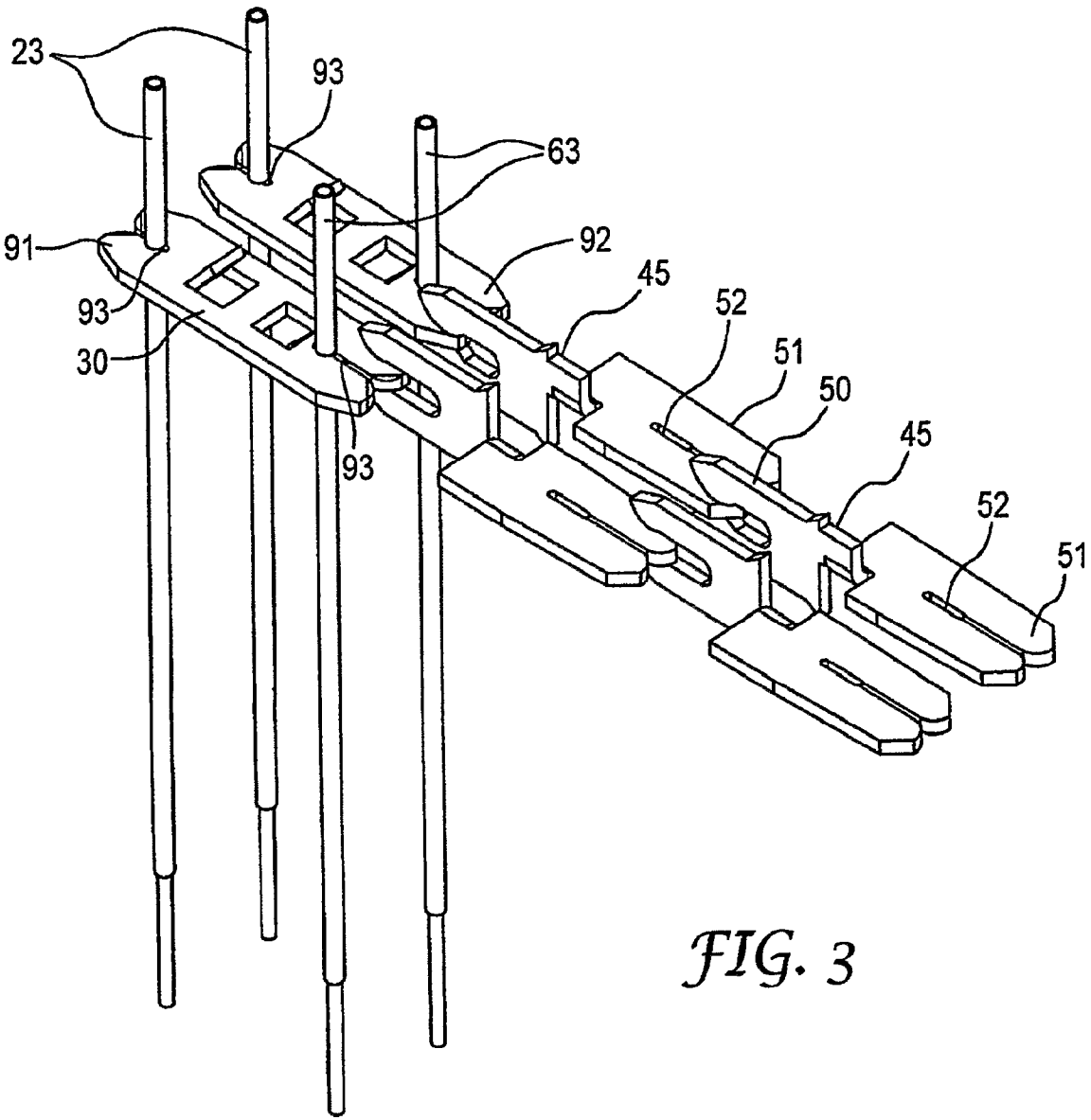
FIG. 3 shows the shape of the terminal in the terminal block of the present invention and the situation that the first set of wires and the second set of wires are connected; the terminal can further be connected with the splicing contacts in the plug.

FIG. 3 shows the structure of a terminal 30 applied in the present invention. The terminal 30 is made of a conductive metal material, and has two ends that are substantially U-shaped, namely, a first end 91 and a second end 92, which have a U-shaped slot 93 thereon respectively. The U-shaped slots 93 are engaged with the first set of wires 23 and the second set of wires 63 respectively. The U-shaped ends have a function similar to a U-shaped blade, and can cut off the insulative layers of the wires inserted in them to get into contact with conductors in the wires.

As shown in FIG. 2B, to make the wires easier to be pressed into the U-shaped slots 93 of the terminals 30, the terminals 30 must be fixed in the slots 25 of the base 21, and the open ends of the U-shaped slots 93 of the terminals 30 must be chamfered or rounded. Preferably, the width of the slots 25 is approximately equal to or slightly greater than the thickness of the terminals 30, such that the terminals 30 are held and will not shake or rotate in the base 21. Moreover, flukes or barbs 301, 302 with a width greater than that of the slots 25 are formed in regions besides the electrical contact regions of the terminals, and spaces for accommodating the flukes or barbs 301, 302 are formed in the slots 25. When the depth that the terminals 30 are inserted in the slots 25 reaches a certain value, the flukes or barbs 301, 302 are released from the narrow width of the slots 25, and are secured in the accommodating spaces. Thus, the terminals are secured in the slots 25, and will not slide vertically.

Figure 4:
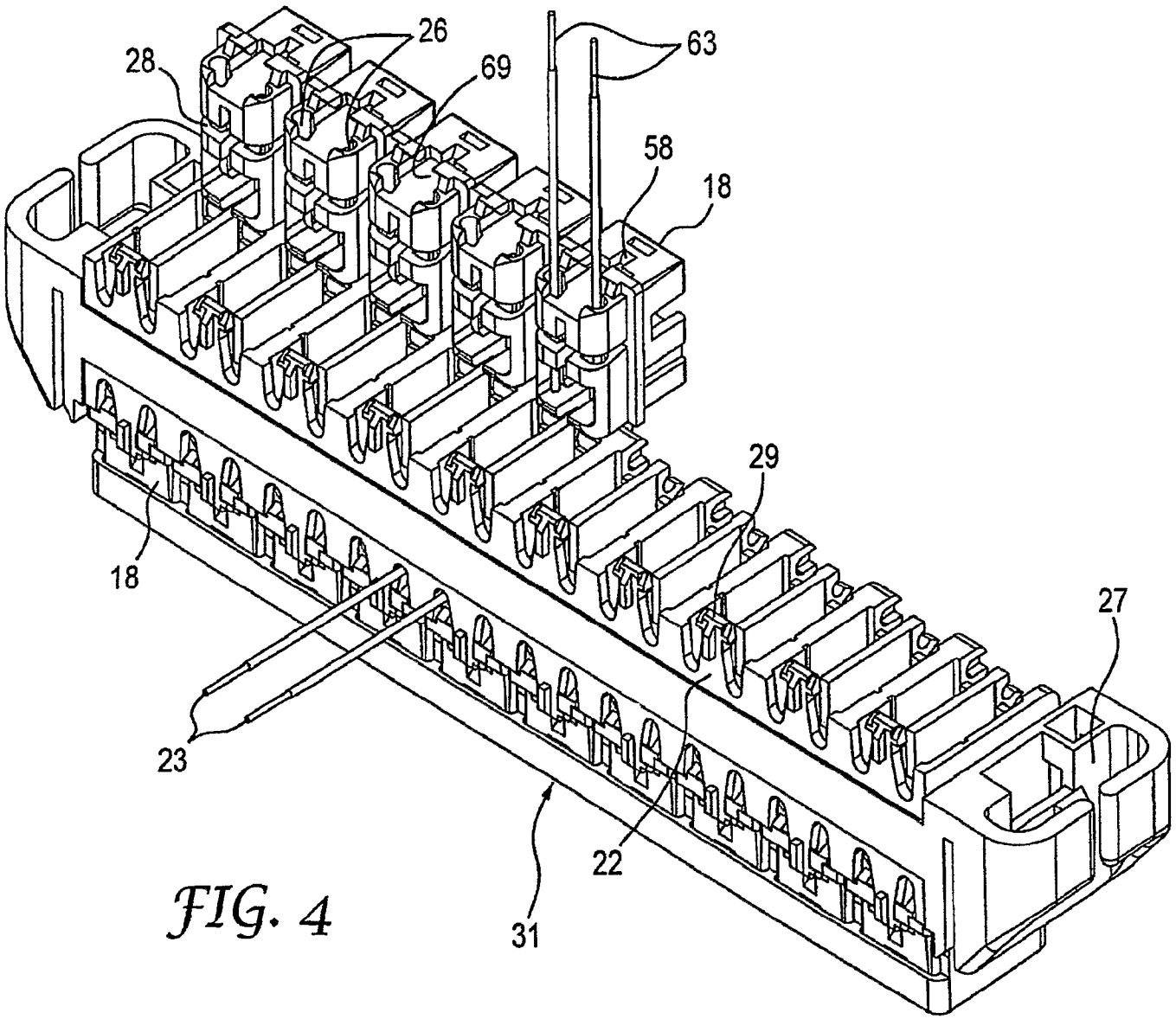
FIG. 4 is a perspective view showing the covers of the terminal block of the present invention are hinged to the base and are opened, and showing the situation that the wires are arranged on the covers.

FIG. 4 shows the state that the covers 18 are arranged in the base 21 and are opened, and the structure of the portion of the covers 18 accommodating the wires is well illustrated. The covers 18 are respectively disposed on two opposite upper and lower ends of the base 21 (i.e., the first cover and the second cover), that is, are disposed outside the first end 91 and the second end 92 of each set of terminals 30. Each of the covers 18 has a wire support means 26 for supporting a set of wires 23 or 63. Preferably, the wire support means 26 is a set of tubular channels. A certain length of the end of the wire 23 is placed into the tubular channel, such that the end of the wire 23 is held. The wall of the tubular channel has a transverse gap 28, when the cover 18 and the base 21 are under the close state, the transverse gap 28 is in a corresponding position to the terminal 30 and the slot 25. The width of the transverse gap 28 is slightly greater than the thickness of the terminal 30. The cover 18 with the wires 23 installed (the first cover) covers the base 21, and at this time, the U-shaped end 91 of the terminal 30 is inserted into the transverse gap 28. The blades on two sides of the U-shaped slot 93 cut off the insulative layer of the wire 23, and get into contact with the conductor in the wire 23. Thus, a set of wires 23 is installed in the terminal block 16 successfully. Similarly, the other set of wires 63 is installed in the cover 18 on the other side of the base 21 (the second cover), and the cover 18 is covered on the base 21. Thus, the cross connection of the second set of wires 63 and the first set of wires 23 is completed.

The covers 18 are not limited to support a set of wires only. A plurality of covers can be formed as one piece. In such condition, several sets of wires can be electrically connected to the terminals 30 in the base 21 at one time. To enable the operator to switch the wire sets conveniently, the covers 18 can be further designed in a way that the operators can open or close the covers 18 conveniently, as shown in FIG. 4. Preferably, one edge of each of the covers 18 is hinged to the base 21, and buckling structures are arranged on the other side of the cover 18 and the corresponding position of the base respectively, such that the operator can release the buckled cover through rotating it. After the wires are placed in, the operator rotates the cover 18 again to buckle it onto the base 21, such that the wires to be switched and the terminals 30 are electrically connected. A preferable buckling structure is the structure that, a T-shaped buckling portion 29 is formed at the top of the post 22 on the base 21, and a ╬-shaped or "][”-shaped detent slot 69 allowing the T-shaped buckling portion 29 to pass through is formed on the cover 18. The outer side of the front edge of the T-shaped buckling portion 29 is chamfered, such that when the cover 18 covers downward, it is easier to enter the detent slot 69. As the post 22 is an elastic cantilever beam structure, when the T-shaped buckling portion 29 passes through the detent slot 69, the post 22 is flexed slightly, but after the T-shaped buckling portion 29 passes through the detent slot 69, the post 22 will restore to the original vertical position. At this time, the T-shaped buckling portion 29 abuts against a side plane of the detent slot 69 and is fixed, and thus the cover 18 cannot rotate anymore. When the operator wants to open the cover 18, the operator can slightly pull the T-shaped buckling portion 29 outward, and rotate the cover 18 to open it. Here, the advantage of the elasticity of the cantilever beam structure of the post 22 is taken as well.

Figure 5:
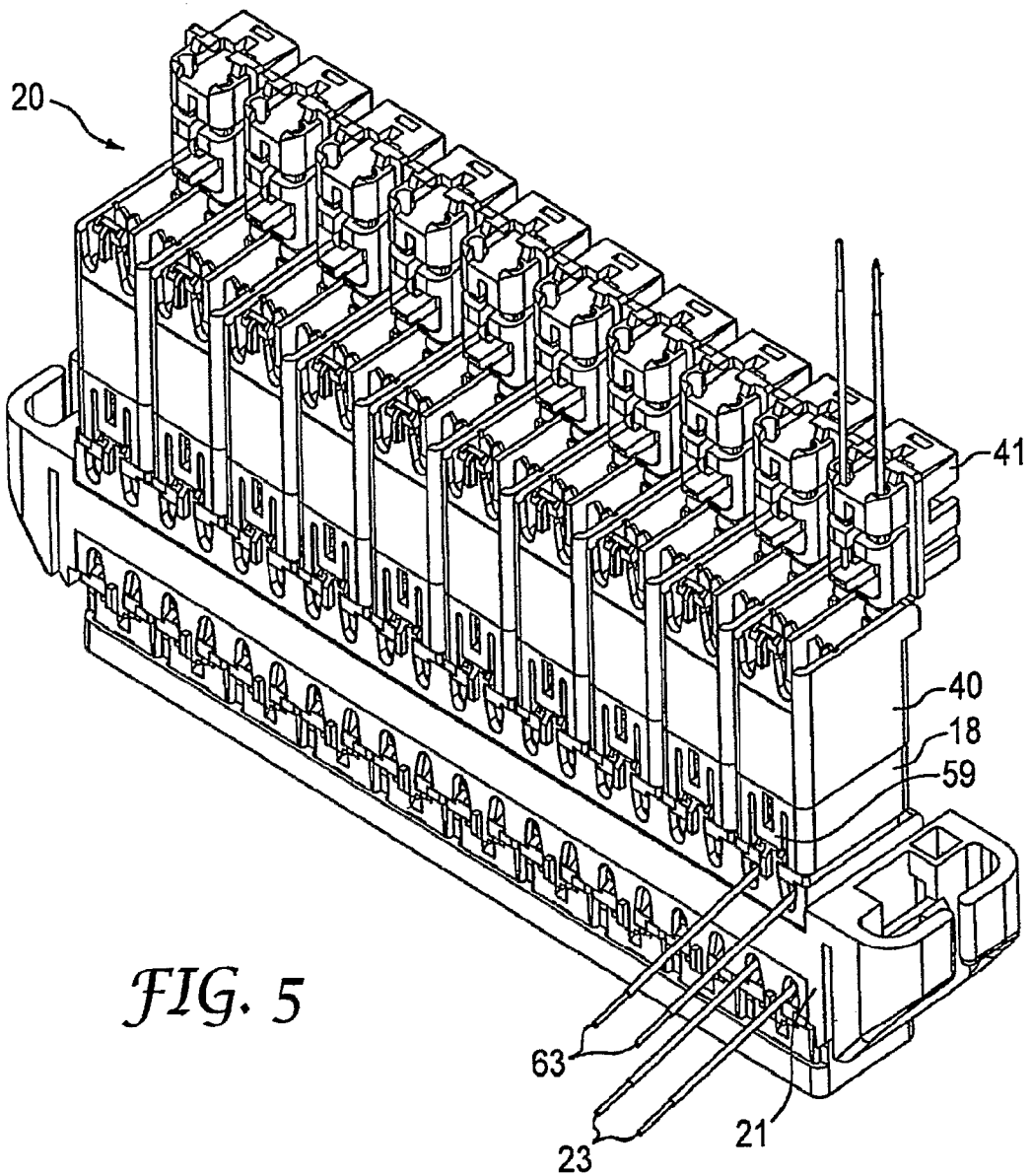
FIG. 5 is a perspective view showing that after the terminal block of the present invention is connected to the first set of wires and the second set of wires, the plug is plugged into the terminal block and is connected to the third set of wires, which shows the state that the cap of the plug has been opened and has accommodated the third set of wires.

As shown in FIG. 5, in the second embodiment of the present invention, to obtain the convenience of jumper wires, the terminal block 16 that has connected the first set of wires 23 and the second set of wires 63 can be further electrically connected to a third set of wires and/or a fourth set of wires. In this method of connection, the cover 18 on one side or two sides of the base 21 is connected to a plug 20 that has connected the third set of wires and/or the fourth set of wires. At this time, a set of apertures 35 must be formed on the outer side of the cover 18 (FIG. 1A) to provide the channel along which the splicing contacts of the plug 20 enter into the base 21 and connect to the terminals 30.

Figure 7:
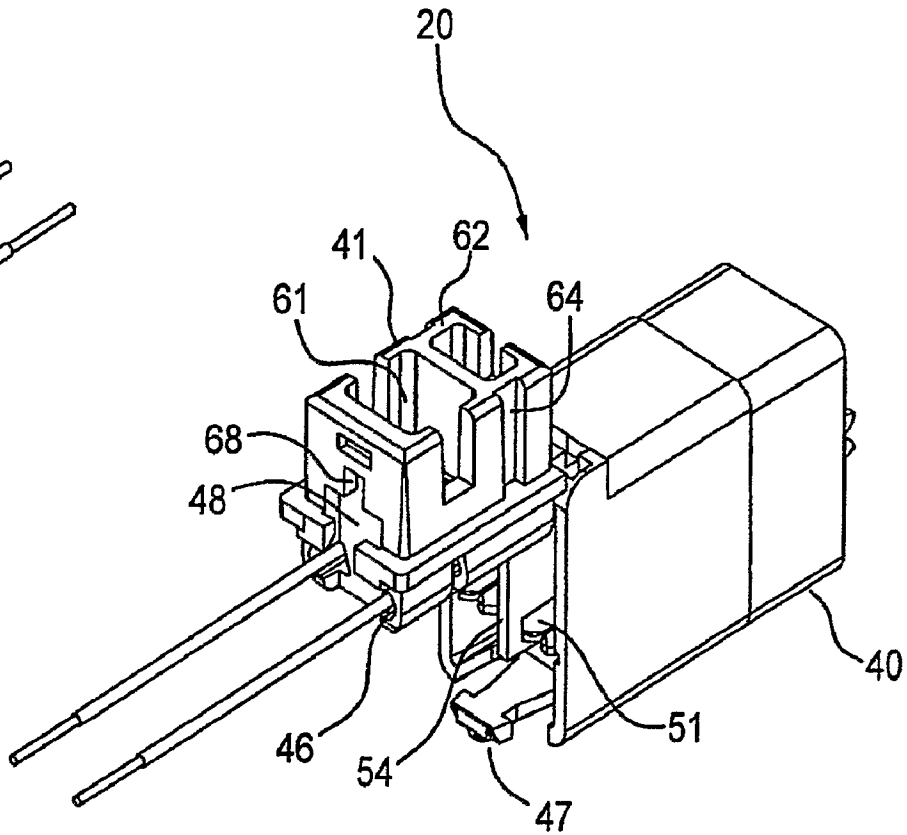
FIG. 7 is a perspective view of the plug of FIG. 5, and mainly shows the detailed structure of the cap side of the plug.
Figure 6:
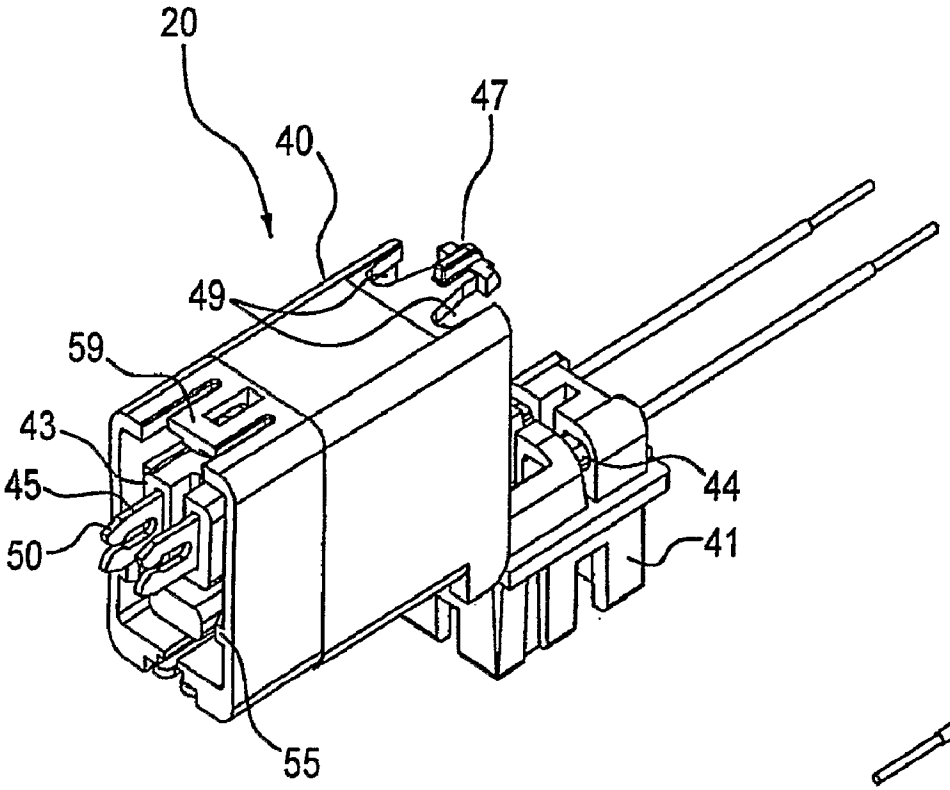
FIG. 6 is a perspective view of the plug of FIG. 5, and mainly shows the detailed structure where the plug body is going to connect to the covers.
Figure 9:
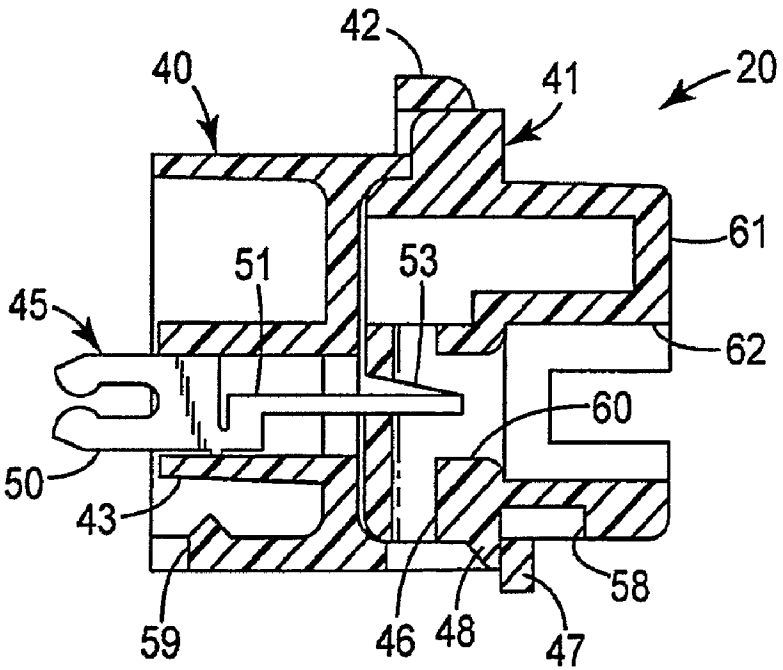
FIG. 9 is a transversal sectional view of the cap of the plug of FIG. 7 when it is closed.
Figure 8:
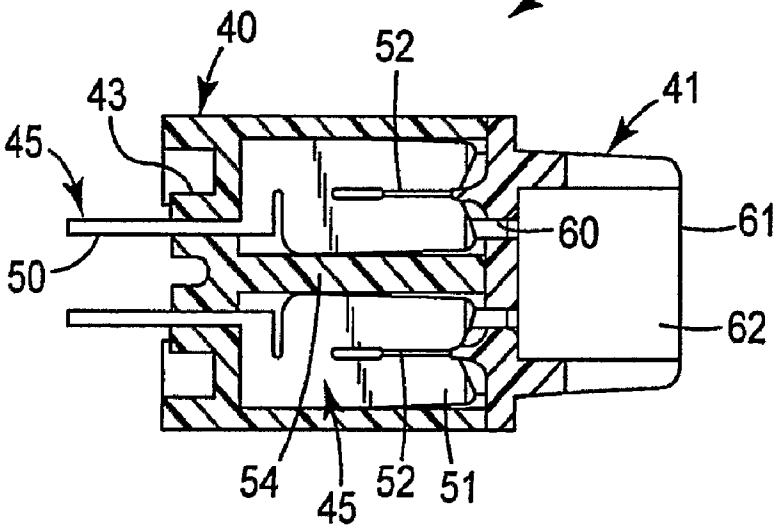
FIG. 8 is a longitudinal sectional view of the cap of the plug of FIG. 7 when it is closed.

FIGS. 6 and 7 show the detailed structure of the plug 20. The plug 20 includes an approximately rectangular electrically insulative body 40 and a cap 41 removably attached to the body 40. The cap 41 is preferably hinged to one edge of the body 40, such that it may be rotated and opened or buckled with the body 40. FIGS. 6 and 7 have shown the situation that a set of wires is placed in the cap 41 when the cap 41 is opened. The body 40 has a set of splicing contacts 45 made of a conductive metal material. FIGS. 8 and 9 are sections of the plug 20 in different directions showing the state that the splicing contacts 45 are held in the plug 20. Each of the splicing contacts 45 has two opposite end portions. A first end portion 50 has the shape of a tuning fork, as shown in FIG. 3, and is used to electrically connect the U-shaped end 91 or 92 of the terminal 30 in the base 21. The second end portion 51 (the end portion for removing the insulative layer of wires) has a U-shaped slot 52, as shown in FIG. 3, and is used to electrically connect the third set of wires or the fourth set of wires placed in the cap 41. The plane of the end portion 51 for removing the insulative layer is at an angle of 90 degrees with reference to the plane of the tuning fork end portion 50. When the set of splicing contacts 45 includes two contacts, as shown in FIG. 3, preferably one of the contacts is turned over along a long axis, such that the contact is disposed at an angle of 180 degrees with reference to the other splicing contact.

A holding portion 43 is formed on the body 40 at the side to be jointed with the cover 18 (see FIG. 6) for holding a set of splicing contacts 45. The first end portion 50 (the tuning fork portion) of each splicing contact 45 extends from a through hole in the holding portion 43, so as to enter the aperture 35 of the cover 18 to be engaged with the terminal 30. When the set of splicing contacts 45 includes two contacts, a thin-wall element 54 formed in the body 40 (see FIG. 7) is disposed between the two splicing contacts 45 for providing electrical isolation.

As shown in FIG. 7, two tubular channels 46 are formed in the cap 41 to accommodate the wires. The peripheral shape of the tubular channels 46 is similar to that of the wire support means 26 on the covers 18. The ends of the wires are placed into the tubular channels 46 at a certain length, such that the ends of the wires are held. A transverse gap 44 is formed in the wall of the tubular channels 46. After the cap 41 is covered onto the body 40, the position of the transverse gap 44 corresponds the U-shaped slot 52 of the second end portion 51 of the splicing contact 45. The width of the transverse gap 44 is slightly greater than the thickness of the splicing contact 45. After the cap 41 with the wires installed is covered onto the body 40, the second end portion 51 of the splicing contact 45 passes through the transverse gap 44, and the blade portions on two sides of the U-shaped slot 52 cut off the insulative layers of the wires, and get into contact with the conductors in the wires. Thus, the third set or the fourth set of wires is installed in the plug 20 successfully.

To prevent the cap 41 from separating from the body 40 after they are buckled, a flexible buckling member 47 is preferably formed on the body 40. The flexible buckling member 47 has recesses 49 formed on both sides, such that the buckling member 47 can easily be opened and spring back. A detent slot 48 is formed on the cap 41. When the cap 41 is closed, the flexible buckling member 47 is slightly flexed to pass through the ⊞-shaped or "] ["-shaped aperture in the detent slot 48, and then springs back to be disposed against a sidewall of the detent slot 48, such that the cap 41 is fixed at a certain position on the body 40.

When the plug 20 is plugged in the cover 18 of the terminal block 16, preferably the plug body 40 and the cover 18 have a keying means. At this time, a wall structure formed outward is disposed around the apertures 35 of the cover 18, and defines a recess 36 for accommodating the end of the body of the plug 20 (see FIGS. 1 and 1A). A concave portion 58 can further be formed on the sidewall of the recess 36. An approximately rectangular wall structure 37 is disposed adjacent to the wall structure defining the recess 36. The ends of the rectangular wall structure 37 have key slots 38 disposed on two opposite outer sides, and the aperture 35 is formed in the recess 36. Meanwhile, as shown in FIG. 6, a ⊞-shaped recess region is formed below the holding portion 43 of the plug body 40 to accommodate the wall structure 37 outside the cover 18. A key tooth 55 is formed on the wall surface of the region, which has a size and shape suitable for being accommodated by the key slot 38 of the wall structure 37 of the cover 18. The key tooth 55 and the key slot 38 provide the function of guiding the correct direction. When the operator does not turn the plug 20 to the correct direction before plugging it into the cover 18, the plug 20 cannot be inserted into the cover 18. Furthermore, the key tooth 55 and the key slot 38 provide additional mechanical support to prevent the forces from side direction (e.g., pulling to the jumper wires) from interfering the electrical connection between the first end portion 50 (the tuning fork portion) of the splicing contact 45 and the terminal 30. Referring to FIG. 6, the plug body 40 is disposed adjacent to the side of the holding portion 43, and has a flexible buckling member 59 formed on the sidewall. The buckling member 59 has a protruding hook portion at its end, which is just accommodated by the concave portion 58 formed on the sidewall of the recess 36 on the cover 18 (see FIG. 1). Thus, the plug 20 is buckled on the cover 18, and the operator has to exert a force greater than a certain value to remove the plug 20 from the cover 18. The external wall structure on the side of the plug body 40 adjacent to the holding portion may just surround the wall structure 37 and the recess 36 of the cover 18, and the holding portion 43 holding the splicing contact 45 is formed to a shape that can be accommodated by the recess 36 on the cover 18. The foregoing shapes, the key tooth 55, the key slot 38, the buckling member 59, and the concave portion 58 cooperate with one other to enable the plug 20 to be inserted in the cover 18 firmly with correct keying.

Figure 10:
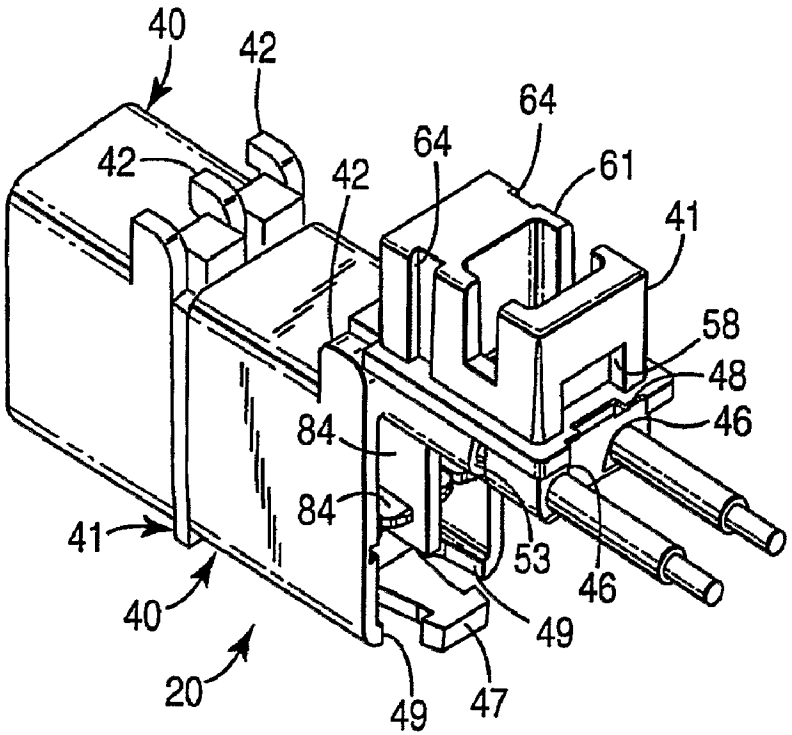
FIG. 10 is a perspective view of the terminal block of the present invention with two plugs stacked thereon, wherein the cap of the upper plug is opened, and a set of wires is in the holding channel of the cap.

To achieve the object that other jumper plugs can be further inserted in the plug 20, other jumper plugs are also fabricated to the shape of the plug 20, and the body 40 of any plug can be inserted into the cap 41 of another plug. Therefore, the external shape of the cap 41 of the plug 20 is substantially the same as the keying means on the cover 18, and the cap 41 also has apertures serving as channels through which the splicing contacts of another plug enter. As shown in FIGS. 8 and 9, the cap 41 has apertures 60 on its top. The wall structure around the apertures 60 defines a wall structure 62, and a recess 61 is formed on the wall surface adjacent to the wall structure 62. The wall structure 62 is used to accommodate the holding portion 43 of the splicing contacts of the body 40 of another plug. The apertures 60 are formed to a shape similar to that of the apertures 35 in the cover 18, and the shapes of the recess 61 and the wall structure 62 are the same as those of the recess 36 and the wall structure 37 (see FIGS. 1 and 7). Furthermore, a key slot 64 is also formed (see FIG. 7), such that when other same or similar jumper plugs are inserted into the plug 20 from above, the key slot 64 of the plug 20 can accommodate the key tooth 55 of another plug. A concave region 68 similar to the concave portion 58 of the cover 18 is also formed above the wall surface detent slot 48 of the cap 41 (see FIGS. 1 and 7), which is also used to accommodate the buckling member 59 of another plug, such that the plugs holds one another when they are stacked. FIG. 10 shows the situation that two plugs 20 are stacked. The connection of contacts in the stacked plugs is shown in FIG. 3, wherein the first end portion 50 (the tuning fork contact portion 5) of a splicing contact 45 is electrically connected to the second end portion 51 of another plug 20.

In a preferred embodiment of the present invention, the joints of the wires and the contacts can be wrapped with a moisture-proof sealant. The sealant is placed around the joints of wires and contacts in the base 21, the cover 18, the body 40, and the cap 41.

Figure 11:
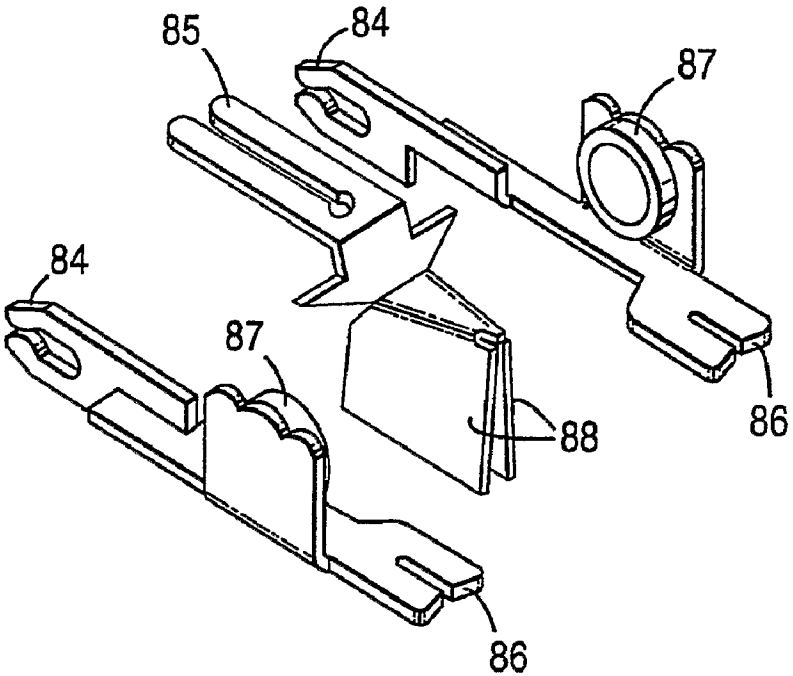
FIG. 11 is an exploded perspective view of the over voltage protection means disposed in the plug in an embodiment of the present invention.
Figure 13:
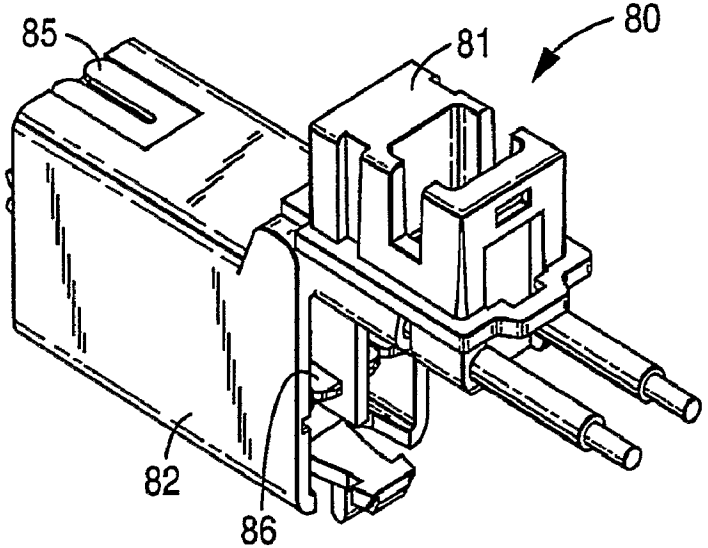
FIG. 13 shows the appearance of the plug having the electrical protection means in an embodiment of the present invention, and the grounding contact of the plug is exposed to the outside to facilitate the connection with other grounding means.
Figure 12A:
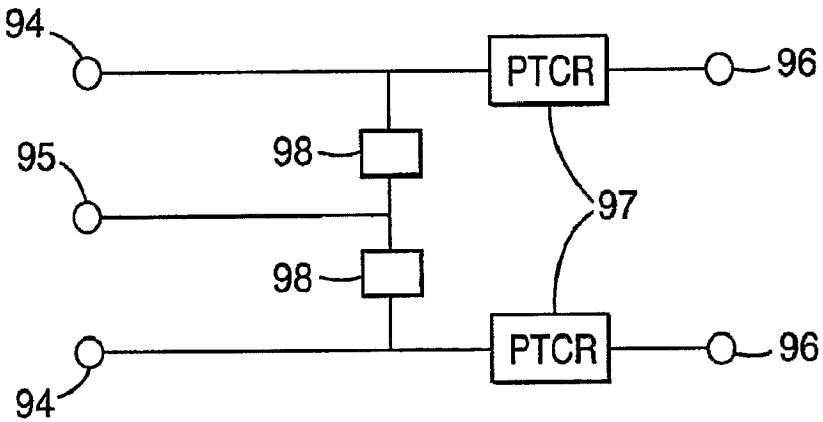
FIG. 12A is a circuit diagram of the over voltage protection means disposed in the plug of FIG. 11.
Figure 12B:
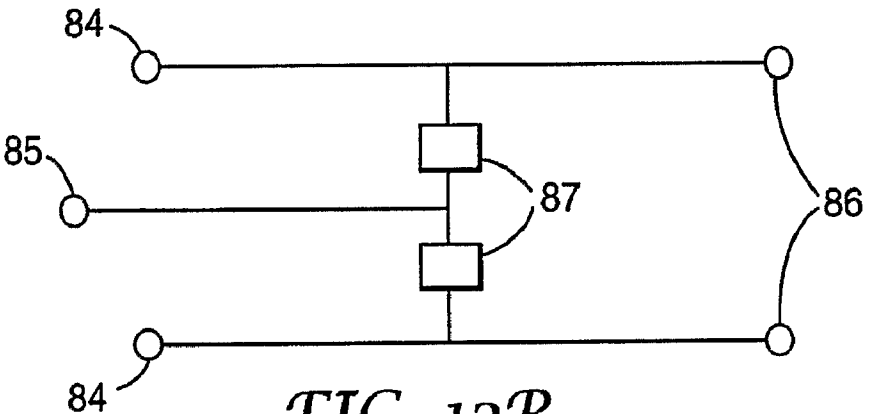
FIG. 12B is a circuit diagram of the over current protection means disposed in the plug of FIG. 14.
Figure 14:
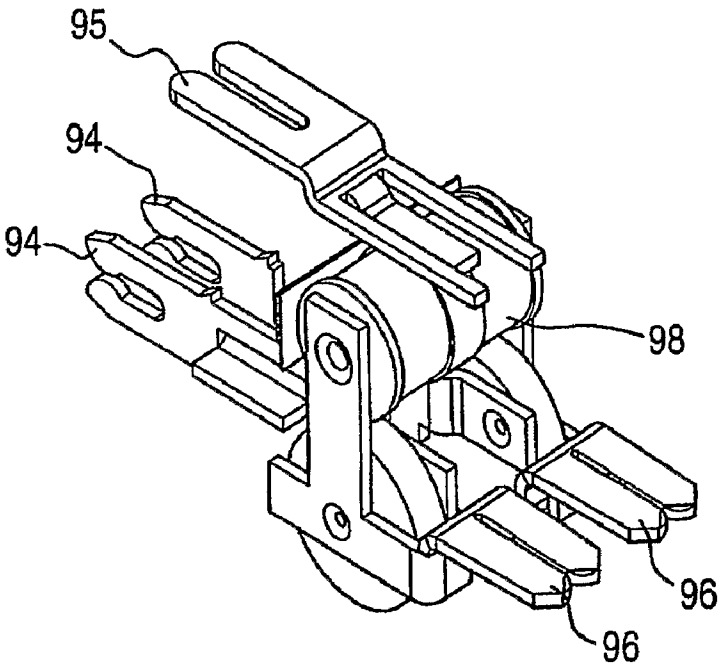
FIG. 14 is a perspective view of the over current protection means disposed in the plug in an embodiment of the present invention.

In the third embodiment of the present invention, the plug 80 connected to the terminal block 16 can also be a means with the electrical protection function. FIG. 11 and FIG. 12A show an over voltage protection means and loop, and FIGS. 14 and 12B show another over current protection means. The two means are configured to be receivable in plugs of similar shapes. The over voltage protection means of FIG. 11 includes two contacts having a shape similar to that of the splicing contacts 45 and connected to a grounding contact 85 via a voltage-limiting element 87 disposed in-between. The contact also includes a contact portion 86 used for removing the insulative layer of the wire and a tuning fork contact portion 84, and further includes a grounding contact 85 having a tail end connected to a blade contact 88. After being combined with the plug body 82, the grounding contact 85 is partially exposed outside the plug body 82, as shown in FIG. 13. In the preferred embodiment, the voltage-limiting element 87 can be a DIAC or a bi-directional trigger diode, which is insulative in the normal state, and turns into the short circuit state when the voltage exceeds a predetermined value, e.g., 270 V. This special element has the advantage of small size, and the diameter of the element is about 0.2 inch. The voltage-limiting element 87 is connected to the grounding contact 85 via the blade contact 88, and the blade contact 88 and the grounding contact 85 are formed as one piece. A wall not shown in this figure is formed along the inner surface of the body 82 to support and position the grounding contact 85.

Figure 15:
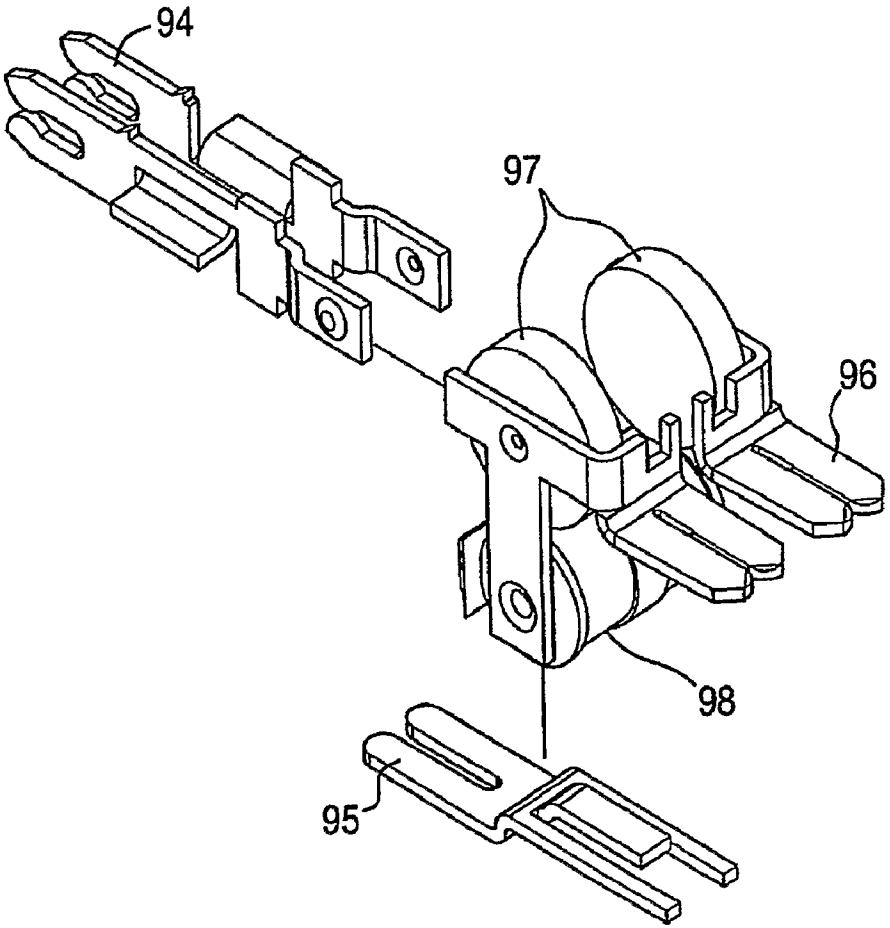
FIG. 15 is an exploded view of the over current protection means disposed in the plug of FIG. 14

FIG. 14 shows an over current protection means arranged in the plug body 82, which includes two sets of contacts having the shape similar to that of the splicing contacts 45. Each set of the contacts includes a contact 96 with the insulative layer removed and a tuning fork contact 94, which are formed as two elements (see FIG. 15). A protruded point is formed at the position where the two contacts contact a current-limiting element 97, so as to facilitate the electrical contact with two opposite sides of the current-limiting element 97. The over current protection means further includes a grounding contact 95, and the tail end of the grounding contact 95 is in electrical contact with a voltage-limiting element 98. The voltage-limiting element 98 is generally a gas discharge tube, such that excessive power can be released from the grounding contact when the voltage is too high. After the grounding contact 95 is combined with the plug body 82, a part of the grounding contact 95 is exposed outside the plug 80, as shown in FIG. 13. The current-limiting element 97 can be a positive temperature co-efficient of resistivity (PRCT) element, and is generally made of a ceramic material. When the current exceeds the working span, the material is heated, and the resistance of the material increases, thus reducing the current.

Figure 16:
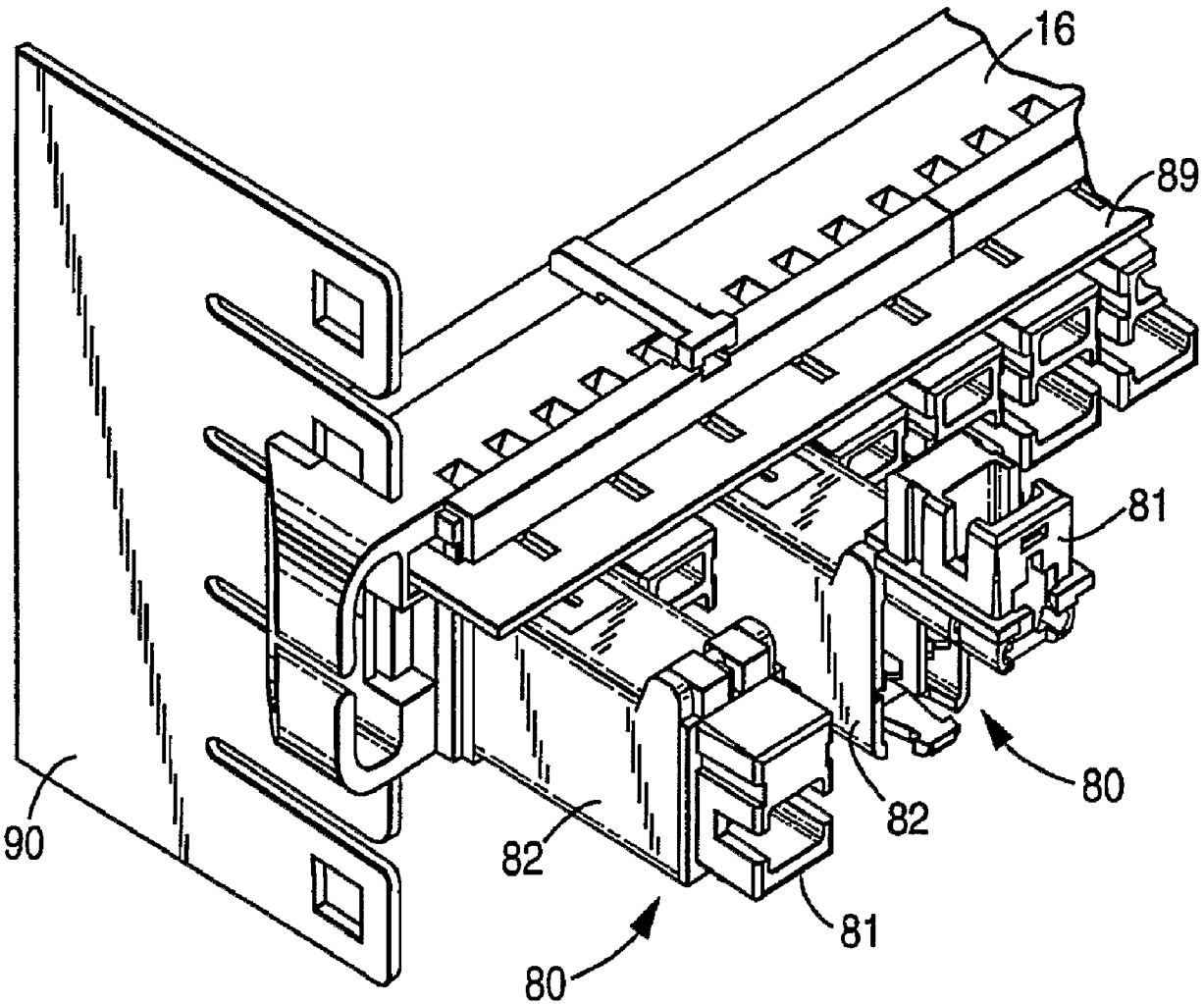
FIG. 16 is a schematic view of an embodiment of the present invention, in which the terminal block is connected with the plug having the electrical protection means and the grounding plate, and is connected to the grounding frame.
Figure 17:
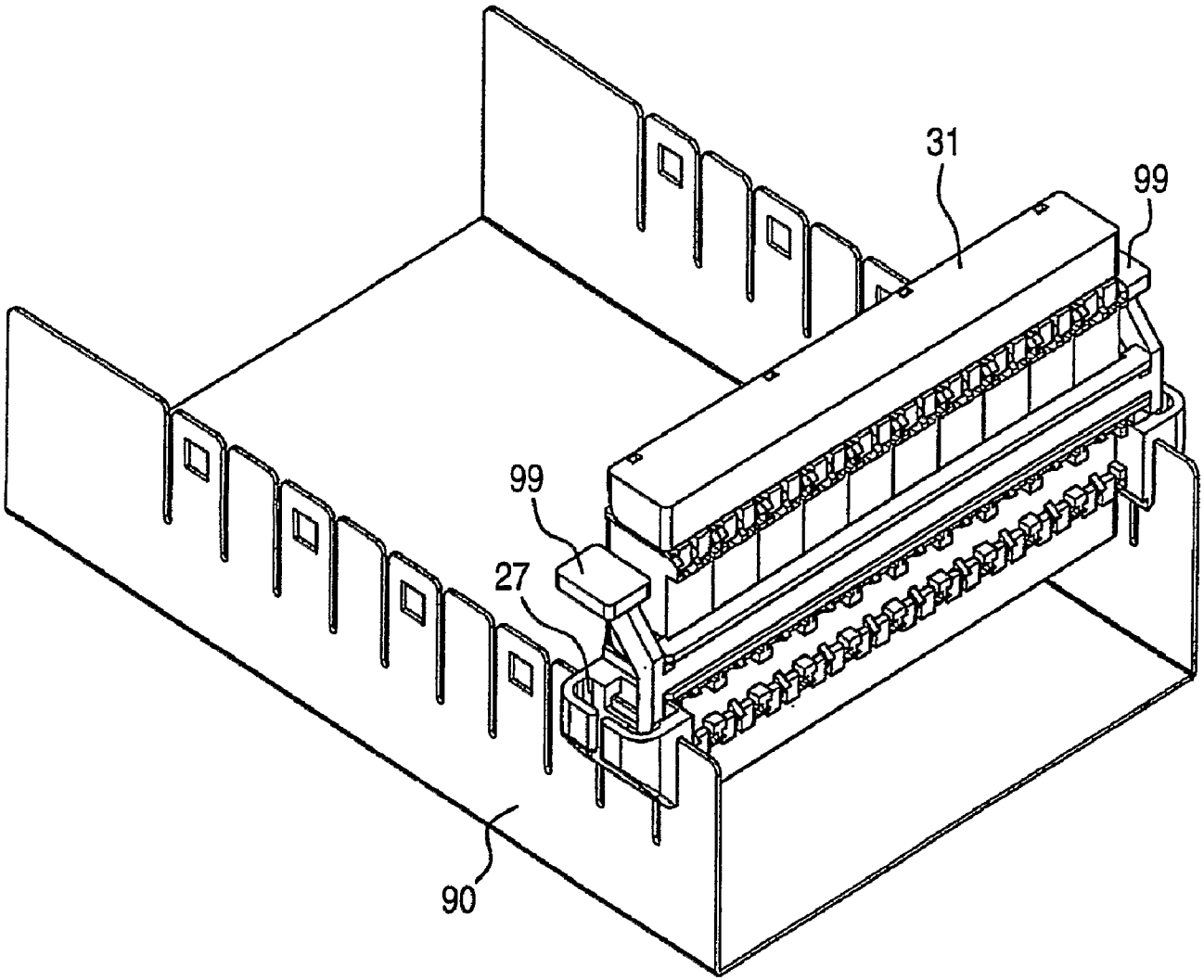
FIG. 17 is a perspective view showing that the terminal block of the present invention covers the protective cap after it is connected with the plug, and then is connected to a large-scale grounding frame after it is connected to the grounding plate.

To provide the electrical connection to the grounding plane, in FIG. 16, the terminal block 16 has a grounding means, which preferably is a plate-shaped element 89 extending to the length of the terminal block 16. The grounding plate 89 is preferably connected to the base 21, but can also be attached to the cover 18. The grounding plate 89 includes a plurality of forked thorns (not shown), which are disposed at positions corresponding to the grounding contacts 85 and 95, so as to be connected to the grounding contacts 85 and 95. Thus, when the plug 80 is attached to the terminal block 16, the grounding contacts 85, 95 are automatically engaged with the thorns on the grounding plate 89. The grounding plate 89 can then be connected to the grounding plane in any convenient manners, for example, connected to a frame 90 expanding outward (see FIG. 17). The frame can then be connected to the grounding plane with large-gauge wires (e.g., 6 AWG wires).

The advantage of using the plug 80 is to prevent or reduce the damage to the wires and other relevant elements caused by sudden increase of voltage or current in the wire, such as lightning strikes. All elements in the loop formed with the plug 80 having the electrical protection means are protected. If the plug 80 moves from a position on the terminal block 16 to another position through jumper connection, the protection loop will move accordingly. Thus, it is unnecessary to rearrange the protection circuit separately, and it is also unnecessary to arrange protection loops at positions of all covers 18 of the terminal block 16. As the cap 81 of the plug 80 having the protection loop has the same shape as that of the cap 41 of the plug 20, any plug 20 can be inserted into the plug 80. Therefore, the protection loop can provide protection to all plugs 20 inserted on it. The operator can optionally connect one side of the terminal block 16 to the first set of wires 23 and leave the other side not connected to any wires, and connect the plug 80 having the protection loop to the terminal block 16, and then connect the second set of wires 63 to the plug 80; or can insert the plug 20 after inserting the plug 80 to the terminal block 16 that has connected the first and the second sets of wires 23, 63, and thus only the elements in the loop having the plug 80 are protected. The operation can be chosen according to respective requirements.

The cross connect terminal block of the present invention has been disclosed in the aforementioned embodiments, while modifications to the present invention can be done without departing from the spirit of the present invention. For example, as shown in FIG. 1, the terminal block 16 has an additional protective cap 31, which has the following two functions: first, the protective cap 31 covers the apertures 35 in the cover 18 that is not connected to the plug, so as to prevent the internal elements, such as the joints or the moisture-proof sealant, from being contaminated by foreign matters; second, the protective cap 31 can be used for recognition: no matter whether the cover 18 has the apertures 35, the protective cap of different colors can be signs to mark the functions or signal types of internal wire sets. The protective cap 31 can also be installed outside the plug cap 41 that has been connected to the cover 18 independently. Though the protective cap 31 shown in the figure is a one-piece formed strip, and can cover the apertures in a plurality of covers 18, according to the spirit of the present invention, the protective cap 31 can be divided to the separate pieces and each covers a single cover 18. In addition, a receptacle 27 can be formed on each end of the base 21 for receiving a display element 99, on which a mark can be made.

Moreover, the terminal block 16 can have a cover 18 capable of carrying five sets of wires at the same time, or the size of the cover 18 and the base 21 corresponding to a single row of terminals 30 can be reduced to narrow down the width of the cover 18 and the base 21. In other words, the width of the portion of the cover 18 and the base 21 for supporting the single row of terminals 30 and having the location means is reduced; or the length of the base 16 is increased to accommodate 25 sets of wires in contrast with the original length for accommodating 10 sets of wires; or the length of the cover 18 is increased; or another contact structure having the protection loop is used; or other electronic elements, such as remote switches (RITs or MTUs), radio frequency filters (RFIs), half rings, fail-short circuit elements and other over voltage or over current limiting elements, are added into the plug 18. The aforementioned and other modifications have been taken into consideration in the claims of the present invention, and have been covered in the appended claims of the present invention.

I claim:

1. A cross connect terminal block, comprising:

a base;

at least one set of terminals disposed in said base, said terminal having a first end and a second end, said first end being used for connecting with a first set of wires and said second end being used for connecting with a second set of wires;

at least a first cover removably disposed on said base and having a support means for supporting said first set of wires, said support means of the first cover being located at a position corresponding to the first end of said terminal; and at least a second cover removably disposed on said base and having a support means for supporting said second set of wires, said support means of the second cover being located at a position corresponding to the second end of said terminal, wherein at least one of said first cover and said second cover has a set of apertures, and said cross connect terminal block further comprises at least a plug, said plug comprising:

an electrically insulative body having a first end and a second end, said body having a set of splicing contacts therein, each splicing contact having a first end portion which is located at said first end of said body and is adapted to make electrical connection with one end of said terminal in said base, and a second end portion which is located at said second end of said body and is adapted to make electrical connection with a third set of wires;

a cap removably disposed at said second end of said body and having a support means for supporting said third set of wires, said support means of said cap being located at a position corresponding to said second end portion of said splicing contact;

whereby when said plug is mating with said first cover or second cover, said first end portion of said splicing contact accesses and connects to one end of said terminal in said base by passing through said set of apertures of said first or second cover.

2. A cross connect terminal block according to claim 1, wherein one edge of said first cover and one edge of said second cover are hinged to said base.

3. A cross connect terminal block according to claim 1, wherein said first end portion of said splicing contact includes a tuning fork structure, and said second end portion of said splicing contact includes a wire insulation displacement structure.

4. A cross connect terminal block according to claim 1, further comprising a protective cap, located at the outside of at least one of said first cover and said second cover.

5. A cross connect terminal block according to claim 1, further comprising a protective cap disposed on said cap of said plug.

6. A cross connect terminal block according to claim 1, wherein said body of said plug further comprises a keying element located at said first end thereof, and at least one of said first cover and said second cover comprises a structure for receiving said keying element.

7. A cross connect terminal block according to claim 6, wherein said first cover and said second cover respectively comprise a location means formed around each of said apertures, said location means is formed in a way that when said plug is mating with said first cover or said second cover, said apertures are oriented to make each of said terminals in a set be connected with the corresponding one of said splicing contacts in said plug; and said first end of said plug is configured to be able to match said location means.

8. A cross connect terminal block according to claim 7, wherein said location means includes a structure formed by walls, which forms a recess around said aperture.

9. A cross connect terminal block according to claim 7, wherein said cap of said plug has a set of apertures and a location means, whereby said cap of said plug is able to mate with said first end of another plug and said splicing contacts of another plug are able to access to said apertures of said plug, so as to make electrical connection with said splicing contacts of said plug.

10. A cross connect terminal block according to claim 1, wherein said base has a plurality of sets of said terminals, and has the same numbers as that of said first covers and that of said second covers, each said first cover and said second cover being disposed on the position corresponding to each set of said terminals in said base.

11. A cross connect terminal block according to claim 10, wherein at least one of said plurality of said first covers and said plurality of said second covers are formed as one piece.

12. A cross connect terminal block according to claim 1, wherein said plug has an electrical protection means for providing electrical protection by limiting one of high voltage over said splicing contacts and current flowing through said splicing contacts, said electrical protection means including a grounding contact.

13. A cross connect terminal block according to claim 12, wherein said first end portion of said splicing contact is formed with a tuning fork portion and said second end portion thereof is formed with a wire insulation displacement portion; and said electrical protection means further comprising a voltage-limiting element inserted between and electrically connected with said splicing contacts, said grounding contact electrically contacting said voltage-limiting element and a portion of said grounding contact being exposed to the outside of said plug after assembly.

14. A cross connect terminal block according to claim 12, further comprising a conductive grounding plate attached to said base, wherein electrical connection is made between said grounding contact of said electrical protection means and said grounding plate.

15. A cross connect terminal block according to claim 14, further comprising a frame electrically connected to said grounding plate.

16. A cross connect terminal block according to claim 14, wherein said first end portion and said second end portion of said splicing contact are separated from each other, said first end portion is a tuning fork portion, and said second end portion is a wire insulation displacement portion; and said electrical protection means further comprising a current-limiting element, the stems of said first end portion and said second end portion being electrically connected with the opposite sides of said current-limiting element respectively; and a voltage-limiting element electrically contacted with said grounding contact, a portion of said grounding contact being exposed to the outside of said plug after assembly.

17. A cross connect terminal block, comprising:

a base;

at least one set of terminals disposed in said base, said terminal having a first end and a second end, said first end being used for connecting with a first set of wires and said second end being used for connecting with a second set of wires;

at least a first cover removably disposed on said base and having a support means for supporting said first set of wires, said support means of the first cover being located at a position corresponding to the first end of said terminal;

at least a second cover removably disposed on said base and having a support means for supporting said second set of wires, said support means of the second cover being located at a position corresponding to the second end of said terminal; and a protective cap, located at the outside of at least one of said first cover and said second cover.

* * * * *